US005549197A

United States Patent [19]

Sutherland

[11] Patent Number: 5,549,197

[45] Date of Patent: Aug. 27, 1996

[54] WRAP-AROUND CARRIER WITH BOTTLE NECK RETAINER TABS

[75] Inventor: Robert L. Sutherland, Kennesaw, Ga.

[73] Assignee: Riverwood International Corporation, Atlanta, Ga.

[21] Appl. No.: 352,461

[22] Filed: Dec. 9, 1994

[51] Int. Cl.[6] ..... B65D 5/36

[52] U.S. Cl. ..... 206/158; 206/434

[58] Field of Search ..... 206/427, 434, 206/139, 141, 149, 158

[56] References Cited

U.S. PATENT DOCUMENTS 4,300,680 11/1981 Champlin ..... 206/427

4,463,852 8/1984 Stone ..... 206/427

4,498,582 2/1985 Tomassi et al. ..... 206/427

*Primary Examiner*—Jacob K. Ackun

[57] ABSTRACT

A wrap-around carrier for packaging necked bottles. Downwardly folded retaining flaps are connected to the transverse edges of bottle neck openings and engage opposite sides of an associated bottle neck to hold the bottle neck in place. Bottom retaining flaps may also be provided at the heel cutouts to hold the bottom portions of the bottles in place.

5 Claims, 4 Drawing Sheets

WRAP-AROUND CARRIER WITH BOTTLE NECK RETAINER TABS

FIELD OF THE INVENTION

This invention relates to wrap-around bottle carriers which contain openings through which the necks of packaged bottles extend. More particularly, it relates to a wrap-around carrier of this type which is provided with additional retaining means for securing the bottles in the carrier.

BACKGROUND OF THE INVENTION

Wrap-around bottle carriers must be designed to hold the packaged bottles in place to prevent them from moving toward the open ends of the carrier during shipment and handling. The necks of the bottles normally extend up through bottle neck openings in the top panel, which restricts movement of the upper portions of the bottles to a degree, while the outer heel portions of the bottles extend through cutouts in the side panels to hold the bottom portions of the bottles in place. Despite the success of such carriers it is sometimes desirable to provide even greater restriction to bottle movement, especially with respect to stabilizing the necks of the bottles. Although the bottle neck openings in the top panels are normally dimensioned so as to prevent any substantial endwise bottle movement, they are not usually small enough to prevent the bottle necks from sliding out at an angle when subjected to sufficiently strong forces. This can be evidenced in wrap-around carriers used for packaging large numbers of bottles. For example, if a wrap-around carrier is made long enough to hold twelve bottles in two rows of six bottles each, the tendency of the bottles to move out the ends of the carrier during lifting and carrying requires greater motion restriction.

One way that has been suggested to more securely grip the bottles in order to prevent movement within a carrier is to provide tabs or flaps at the heel cutouts. These retaining tabs are connected to opposite edges of the heel cutouts and provide restraint to movement of the bottoms of the bottles. This still does not prevent undue movement of the top portions of the bottles in the manner described. At least part of the problem is in the loose fit between the bottle necks and the bottle neck openings, which in large part is unavoidable since the openings have to be somewhat oversized in order to readily receive the bottle necks during the packaging operation.

A main object of the invention, therefore, is to provide a wrap-around bottle carrier having improved bottle neck retaining means. Another object is to provide such means without modifying the basic carrier design in a manner which makes it more difficult or expensive to run through a packaging machine.

BRIEF SUMMARY OF THE INVENTION

In accordance with the invention, the bottle neck openings in a wrap-around carrier containing a plurality of necked bottles extend into the side panels of the carrier, and bottle neck retainer tabs are connected by fold line to opposite transverse edges of the openings. The retainer tabs are folded into the interior of the carrier, contacting opposite surfaces of the associated bottle neck to hold the bottle neck in place.

Each side panel includes an upper portion and a primary portion, with each upper side panel portion being connected by a fold line to the top panel and forming an angle with both the top panel and the primary side panel portion. The bottle neck openings extend into the primary side panel portions from the top panel through adjacent upper side panel portions, and the retainer tabs are connected to the bottle neck openings in the upper side panel portions. In a preferred arrangement the upper side panel portions comprise bevel panels.

To improve bottle security still more, the side panels may be provided with heel apertures to have heel retainer tabs are connected. The heel retainer tabs contact and are biased toward opposite sides of the associated bottles.

The retainer tabs prevent packaged bottles from moving toward the ends of the package and are incorporated in a design which does not add to the cost of the carrier blank or to the expense of forming a carrier from the blank.

The above and other aspects and benefits of the invention will readily be apparent from the more detailed description of the preferred embodiments of the invention which follows.

DETAILED DESCRIPTION OF THE PREFERRED EMBODIMENTS

Figure 1:
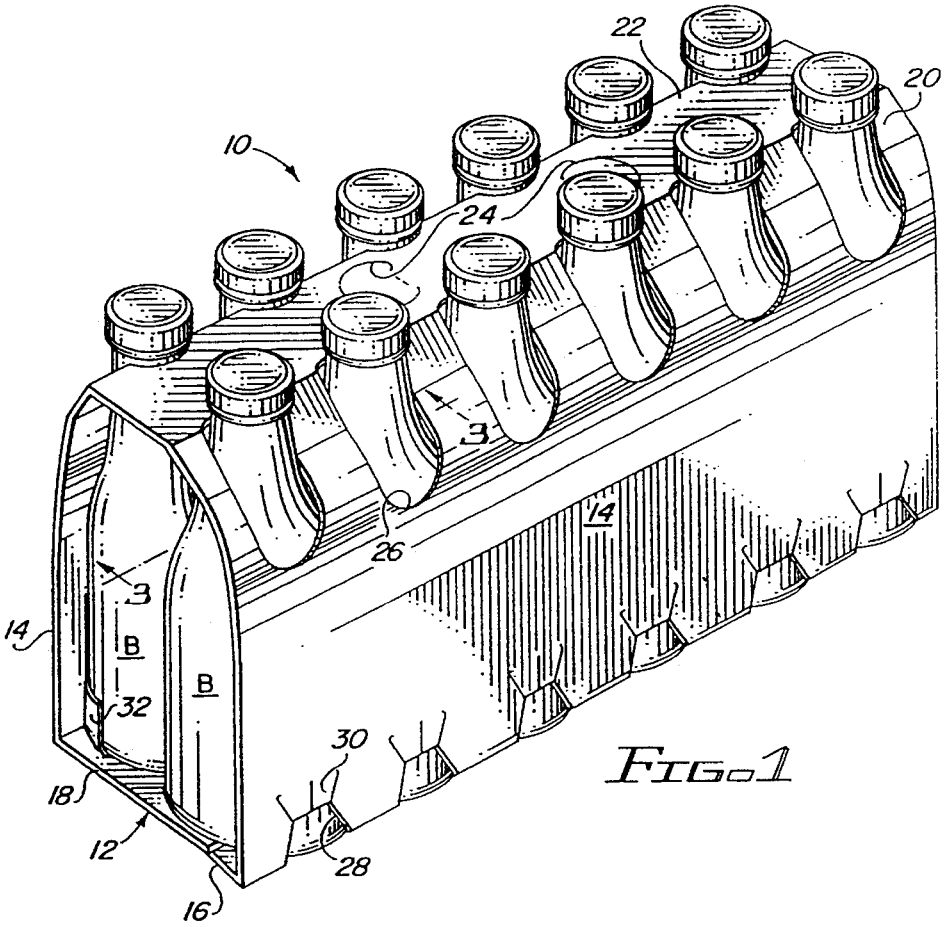
FIG. 1 is a pictorial view of the wrap-around carrier of the invention.

Referring to FIG. 1, the wrap-around carrier 10 is illustrated in connection with twelve beverage bottles B, arranged in two adjacent rows of six bottles each, supported on bottom panel 12. Side panels 14 are connected to bottom panel flaps 16 and 18, which form the bottom panel 12, and to sloped bevel or shoulder panels 20. The bevel panels 20 are in turn connected to top panel 22, which includes finger openings 24 for lifting the carrier. The necks of the bottles extend up through openings 26 which are provided in portions of the top and side panels 22 and 14 and which span the bevel panels 20.

Figure 2:
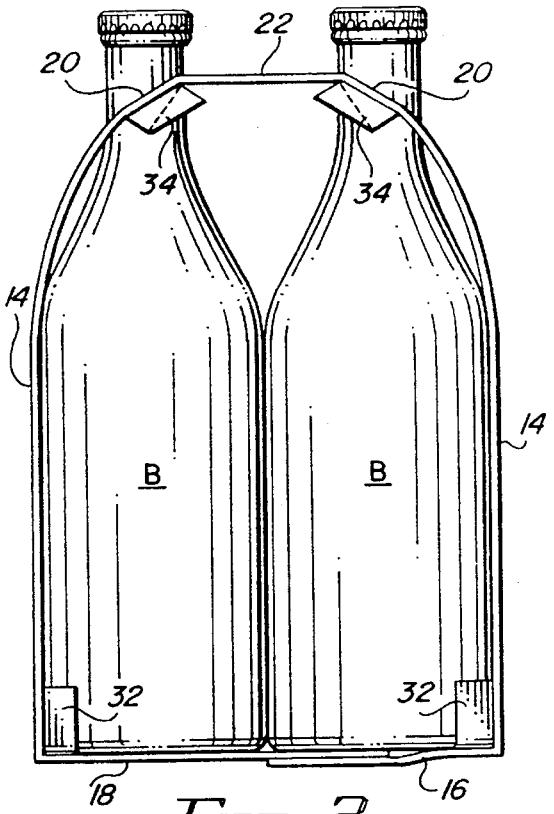
FIG. 2 is an enlarged end view of the carrier of FIG. 1.
Figure 3:
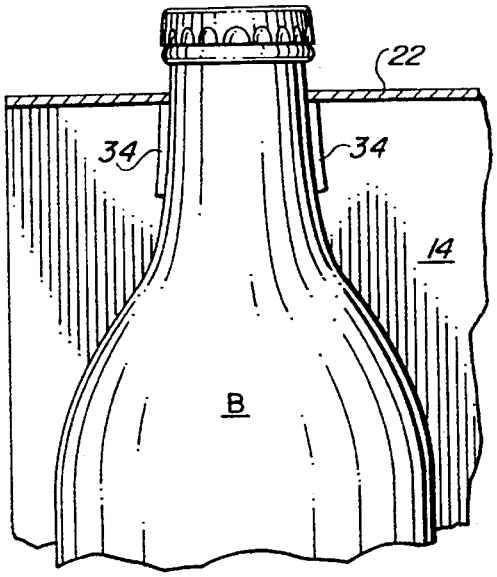
FIG. 3 is an enlarged partial sectional view taken along line 3—3 of FIG. 1.

Cutouts 28 in the side panels receive protruding heel portions of the bottles and tabs 30, which may include vertical slits in their lower edge portions, extend down from the side panels 14 to contact the outer heel portions of the bottles. In addition, heel retainer tabs 32, one of which is visible in FIG. 1, may be provided to restrain movement of the bottom portions of the bottles. It should be understood that the function of heel retainer tabs, although desirable from the standpoint of providing a very secure package, is separate from and does not affect the action of the bottle neck retainer tabs of the invention. As can be seen in FIGS. 2 and 3, bottle neck retainer tabs 34 are connected to opposite edges of the bottle neck openings 26. These tabs are foldably connected to the carrier and exert a biasing force against the bottle necks to restrain movement of the upper portions of the bottles.

Figure 4:
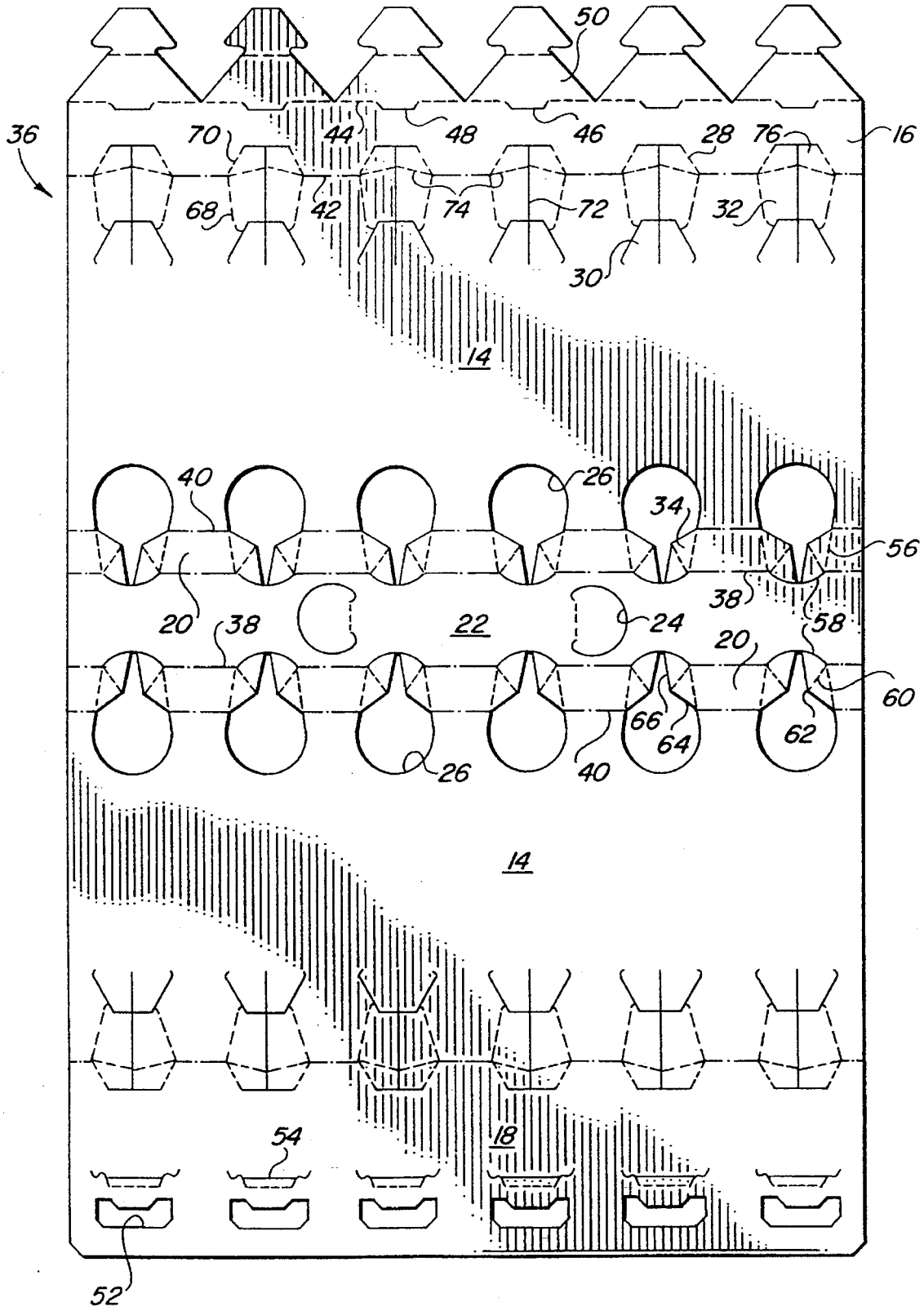
FIG. 4 is a plan view of a blank for forming the carrier of FIG. 1.

Referring now to FIG. 4, wherein like reference numerals to those used in FIGS. 1, 2 and 3 denote like elements, a blank 36 capable of being fabricated into the carrier of FIG. 1 is comprised of a central top panel section 22 connected at opposite sides by fold lines 38 to the bevel or shoulder panel sections 20. Fold lines 40 connect the bevel panel sections 20 to the side panel sections 22, and the side panel sections are connected by fold lines 42 to the bottom panel flaps 16 and 18. The fold lines 38 and 40 are interrupted by the bottle neck openings 26 and the fold line 42 is interrupted by the heel cutouts 28. Included in the bottom panel flap 16 is a fold line 44 which is interrupted by slits 46 forming primary male locking tabs 48. Secondary male locking tabs 50 are connected to the bottom panel flap 16 by the fold line 44. Incorporated in the bottom panel flap 18 are cutouts 52, which include primary female locking edges for engaging the primary male locking tabs 48 and slits 54 for receiving the secondary locking tabs 50. These various locking elements are illustrated to demonstrate a typical bottom panel locking arrangement suitable for use with the carrier of the invention, but it should be understood that any desired effective form of bottom panel locking means may be employed.

Still referring to FIG. 4, the bottle neck retainer tabs 34 are all identical, being connected by fold lines 56 to the edges of the bottle neck openings 26 that extend through the bevel panels 20, while the edges of the tabs 34 in the central top panel section 22 are separated from the top panel section by slits 58. In addition, each retainer tab includes a diagonal fold line 60 which extends from the fold line 38 to the point of intersection 62 of the retainer tab edges 64 and 66. The edges 64 preferably form an obtuse angle with the edges 66. The retainer tabs 32 associated with the heel cutouts 28 are also identical, being connected to the side panel section 14 along fold lines 68 and to the bottom panel flaps 16 and 18 along fold lines 70. The heel retainer tabs of each heel cutout are separated from each other by a slit 72, and each includes a fold line 74.

Figure 5:
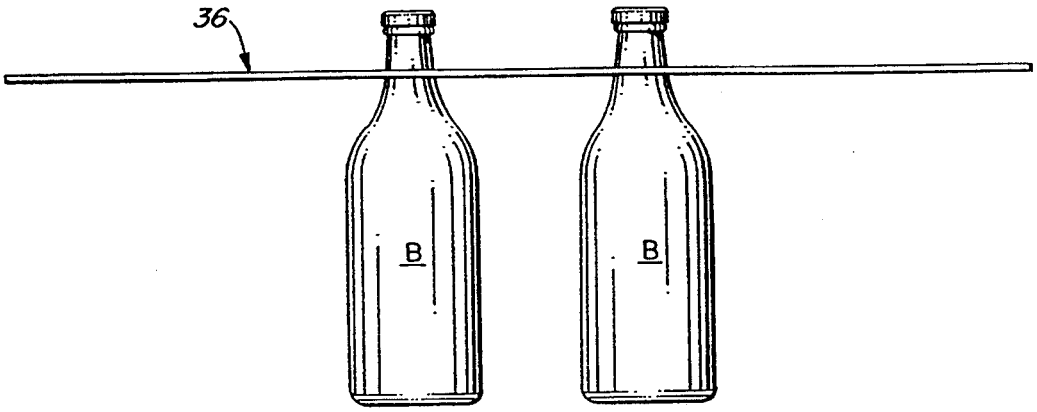
FIG. 5 is an end view of a blank in position to be wrapped around a group of bottles to form a wrap-around carrier package.
Figure 6:
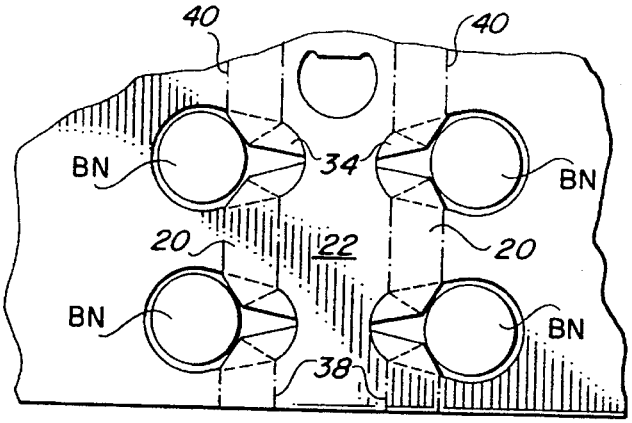
FIG. 6 is a plan view of a portion of the blank of FIG. 5.

To form a package from the carrier blank the bottles are arranged in two rows and the blank is moved into position by lowering it so that the bottle necks extend through the bottle neck openings. Downward movement of the blank is stopped when it is seated on the bottle necks at the point where the diameter of the necks is no longer of a size capable of passing through the bottle neck openings. The blank and bottles at this point are as illustrated in FIGS. 5 and 6. Note that the two rows of bottles are spaced apart to allow the bottle necks BN to be aligned with the portions of the bottle neck openings located outwardly of the retainer tabs 34.

Figure 7:
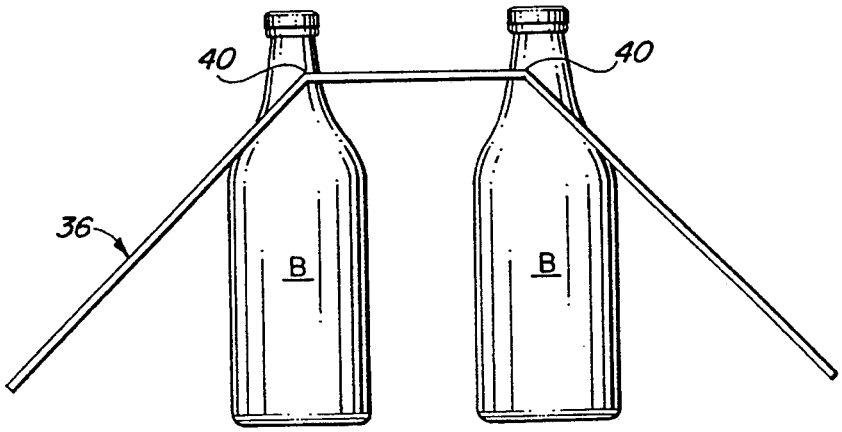
FIG. 7 is an end view of the blank after it has been folded to an interim position during the carrier forming process.
Figure 8:
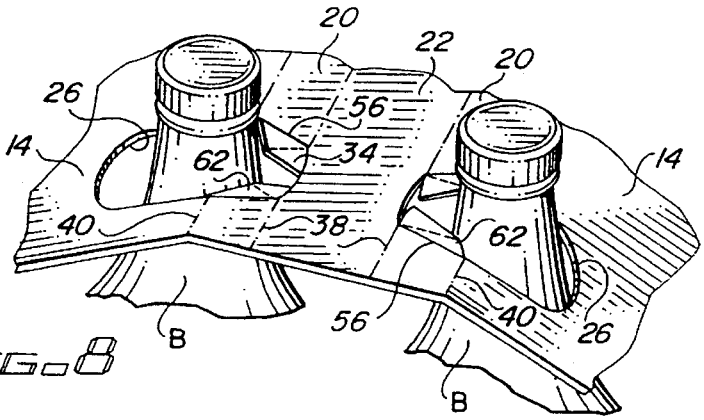
FIG. 8 is a partial pictorial view of the blank corresponding to the interim position of FIG. 7.

The blank is then folded down about the fold lines 40 to pivot the side panels down while at the same time drawing the bottles together. A typical stage of this forming step is illustrated in FIGS. 7 and 8. Note that the top panel at this point is higher on the bottle necks than at the beginning of the forming process, illustrating the upward bowing of the carrier blank that takes place as a package is formed. This occurs in the following manner. When the blank is initially set in place on the bottles the inner and outer edges of the bottle neck cutouts 26 lie substantially in the same plane. As the rows of bottles are moved toward each other and the side panels are folded down, the outer edges of the cutouts slide down the bottle necks to a lower level than the inner edges of the cutouts. At the same time, movement of the bottles toward each other exerts a force on the corners 62 of the retainer tabs 34. This causes the retainer tabs to yield, pivoting down about their fold lines 56. As these various movements continue and the bottle necks engage more and more surface area of the downwardly pivoting retainer tabs, the vertical plane in which the outer edge of the cutout lies moves closer to the vertical plane in which the inner edge of the cutout lies. To compensate for these relative movements between the side panel sections, the bottle neck cutouts and the top panel section, the portion of the blank between the rows of bottles bows up, causing the inner edge of the bottle neck cutouts to slide up on the bottle necks.

When the rows of bottles have been moved to their final engaged position, the retainer tabs 34 will have been folded down to the position shown in FIGS. 2 and 3. The bias exerted by the folds 56 tending to pivot the retainer tabs of each pair back up to their original position causes the opposing tabs at each bottle neck to firmly hold the bottle neck in place, thus maintaining the security of the bottles and the integrity of the package. The fold lines 60 in the tabs allow the tabs to yield as required in order to better fully contact the contour of the bottle necks during the package forming process. The obtuse angle formed by the edges 64 and 66 of the retainer tabs allows the corner 62 of the tabs to more readily slide down the associated bottle necks as the carrier forming continues.

It is preferred, in order to secure the bottles in place at their bottoms as well as at their neck portions, to provide the lower retainer tabs 32 as well. While the blank is being folded down, the retainer tabs 32 are folded in so that each pair of tabs is positioned on opposite sides of an associated bottle. The blank is then pulled tightly around the bottles, and the bottom panel flaps are locked together by the locking tabs to form the bottom panel 12. Because the lower retainer tabs are folded about the angled fold lines 68 and 70 a bias is created tending to return the tabs to their original position. This causes the tabs to maintain a steady pressure against an adjacent bottle, assisting to hold the bottle in place.

Figure 9:
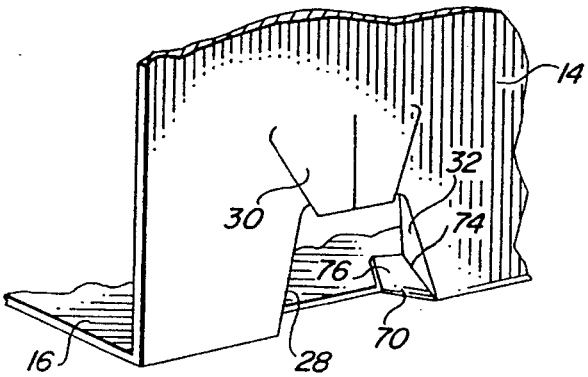
FIG. 9 is a partial pictorial view of the lower end of a carrier formed from the blank of FIG. 4.

As the retainer tabs 32 are folded in about their fold lines 68 and 70 the portion of the tabs between the fold lines 70 and the slits 72, designated by reference numeral 76, pivots about the fold lines 74, moving to a position flat against the bottom panel flap 52. This arrangement is illustrated in FIG. 9. As this hinged movement of the tabs takes place, the tab segments 76 move below the adjacent bottle, so that the bottle rests on these segments as well as on the bottom panel. The weight of the bottle on the segments 76 holds the retainer tabs in their biased position secure against forces which might tend to move the side portions of the retainer tabs away from the bottles.

Figure 10:
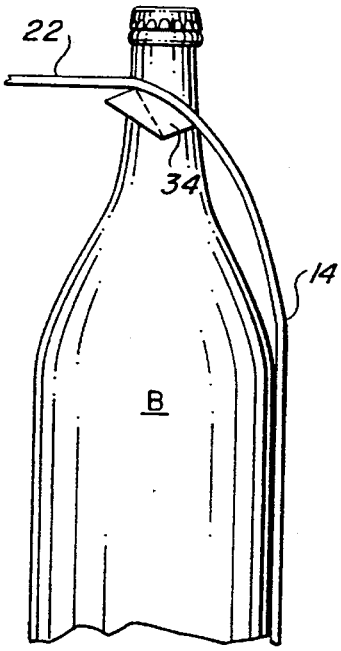
FIG. 10 is a partial end view of a carrier which does not include a separate bevel panel.

Although the portion of the carrier to which the bottle neck retainer tabs are connected has been indicated as the bevel panels 20, it will be understood that bevel panels are not essential, although comparable structure must be provided. For example, as shown in FIG. 10, the side panel could be connected directly to the top panel, with the flexibility of the side panel allowing it to follow the contour of the bottles. In such a case the side panel may be said to be comprised of an upper portion, which performs the function of a bevel panel and to which the bottle neck retainer tabs are connected, and a primary portion, corresponding to the vertical portion of the side panel shown in FIG. 10. In either case the bottle neck retainer tabs are connected to the carrier at a location which extends at an angle to both the horizontal top panel and the vertical side panel in order for the retainer tabs to be in a position to contact opposite sides of an associated bottle neck.

The carrier should be formed of a material which is sufficiently flexible to permit folding into final form and to provide the biasing properties required of the tab fold lines. Paperboard of the type typically employed in the carrier industry is the preferred choice, since it is economical, readily foldable, and its fibrous nature causes the retaining flap fold lines to be sufficiently biased toward the interior of the package. It will be appreciated that the thickness of the package material has been exaggerated somewhat in the drawing in order to indicate the thickness of the sheet material.

It should now be apparent that the invention provides improved article retaining means in a wrap-around carrier in an economical efficient manner. Because the retainer tabs greatly improve the ability of wrap-around carriers to prevent movement of packaged bottles toward the ends of a carrier, long carriers can now be provided for packaging large numbers of bottles without fear of the end bottles being forced from the package due to the outward pressures to which the bottles are subjected during carrying. The ability to stabilize the bottle necks is of primary importance in providing such a package. In addition to their primary bottle neck retaining function, the bottle neck retainer tabs also help prevent tearing at the points where the score lines 38 and 40 meet the edges of the bottle neck openings, providing stress relief at these critical points during lifting and carrying of the carrier.

It will be appreciated by those skilled in the art that the invention is not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A wrap-around carrier containing a plurality of necked bottles, comprising:

a pair of opposite side panels, each side panel including an upper portion and a lower primary portion, each upper side panel portion being connected by a fold line to a top panel and each primary side panel portion being connected by a fold line to a bottom panel;

each upper side panel portion forming an angle with the top panel and with an associated primary side panel portion;

the carrier including a plurality of openings through which the necks of the bottles extend, each opening extending entirely across the upper portion of each side panel, and partially into both the primary side panel portion adjacent thereto and the top panel;

each opening having opposite transverse edges in the upper side panel portions; and an inwardly folded bottle neck retainer tab connected by a fold line to each transverse edge of the openings;

the retainer tabs of each opening contacting opposite surfaces of the bottle neck associated therewith to hold the bottle neck in place.

2. A wrap-around carrier as defined in claim 1, wherein each upper side panel portion comprises a bevel panel connected to an associated primary side panel portion by a fold line.

3. A wrap-around carrier as defined in claim 1, wherein the bottle neck retainer tabs include an edge opposite the fold line connecting the retainer tabs to the transverse edges of the openings, the retainer tabs including an intermediate fold line extending from said edge to said fold line.

4. A substantially rectangular blank for forming a wrap-around carrier for use in packaging necked bottles, comprising:

a centrally located top panel section;

two side panel sections, each side panel section including an upper portion and a primary portion, each upper side panel section portion being connected by a fold line to the top panel section and each side panel primary section being connected to a bottom panel flap for forming the bottom panel of a carrier formed from the blank;

the blank including a plurality of openings through which the necks of bottles packaged in a carrier formed from the blank extend, each opening extending entirely across the upper portion of each side panel section and partially into both the primary portion of the side panel section adjacent thereto and the top panel;

each opening having opposite transverse edges in the upper portion of an associated side panel section; and a bottle neck retainer tab connected by a fold line to each transverse edge of the openings;

the retainer tabs of each opening, when folded into the interior of a carrier formed from the blank, contacting opposite surfaces of a bottle neck associated therewith to hold the bottle neck in place and wherein each upper side panel section portion comprises a bevel panel section connected to an associated primary side panel section portion by a fold line.

5. A wrap-around carrier blank as defined in claim 4, wherein the bottle neck retainer tabs include a first edge opposite the fold line connecting the retainer tabs to the transverse edges of the openings, the retainer tabs including an intermediate fold line extending from said first edge to said fold line.

* * * * *